US008720842B2

(12) United States Patent
Huang et al.

(10) Patent No.: US 8,720,842 B2
(45) Date of Patent: May 13, 2014

(54) HANGER DEVICE FOR A CAR MAT

(76) Inventors: Wei-Jyh Huang, Taipei (TW); Wang Chih Chen, Tainan (TW)

( * ) Notice: Subject to any disclaimer, the term of this patent is extended or adjusted under 35 U.S.C. 154(b) by 171 days.

(21) Appl. No.: 13/531,696

(22) Filed: Jun. 25, 2012

(65) Prior Publication Data

US 2013/0340259 A1 Dec. 26, 2013

(51) Int. Cl.

| | |
|---|---|
| ***B60N 3/04*** | (2006.01) |
| ***A47F 5/00*** | (2006.01) |
| ***A47F 7/00*** | (2006.01) |

(52) U.S. Cl.

USPC ..... 248/339; 248/340; 211/45; 211/113; 223/87; 223/91

(58) Field of Classification Search

CPC ..... A47B 5/00; A47B 7/00; B60N 3/04
USPC ..... 296/27.23, 97.23; 16/4; 223/87, 91; 211/45, 113; 248/339, 340; 428/138, 428/166, 167

See application file for complete search history.

(56) References Cited

U.S. PATENT DOCUMENTS

| | | | | |
|---|---|---|---|---|
| D287,085 | S * | 12/1986 | Leeds | D6/513 |
| 4,856,654 | A * | 8/1989 | Reuben | 206/449 |
| 5,097,996 | A * | 3/1992 | Chen | 223/91 |
| 5,724,703 | A * | 3/1998 | Wu | 16/4 |
| 6,394,287 | B2 * | 5/2002 | Cabrera | 211/70.2 |
| D525,661 | S * | 7/2006 | Hussaini et al. | D20/43 |
| 7,753,241 | B2 * | 7/2010 | Masanek, Jr. | 223/91 |
| 8,087,520 | B2 * | 1/2012 | Milella et al. | 211/45 |
| 2006/0226178 | A1 * | 10/2006 | Wu | 223/85 |
| 2007/0145085 | A1 * | 6/2007 | Masanek | 223/96 |
| 2009/0308899 | A1 * | 12/2009 | Masanek, Jr. | 223/91 |
| 2011/0095155 | A1 * | 4/2011 | Milella et al. | 248/339 |
| 2013/0287996 | A1 * | 10/2013 | Masanek et al. | 428/131 |

FOREIGN PATENT DOCUMENTS

| | | | |
|---|---|---|---|
| DE | 4409297 | A1 * | 9/1995 |
| DE | 202006004014 | U1 * | 7/2006 |
| DE | 202012008799 | U1 * | 1/2013 |

* cited by examiner

*Primary Examiner* — Terrell McKinnon
*Assistant Examiner* — Eret McNichols

(57) ABSTRACT

A hanger device is made of a rigid plastic material and includes a hooked portion and a plate formed below the hooked portion. The plate includes a coupling portion and a plurality of annular portions. A car mat is coupled with the coupling portion. At least one fixing device is integrally formed on at least one of the annular portions. The at least one fixing device includes a through-hole. The at least one fixing device is separable from the at least one of the annular portions. The at least one fixing device is to be mounted to the car mat.

3 Claims, 11 Drawing Sheets

A-A

HANGER DEVICE FOR A CAR MAT

BACKGROUND OF THE INVENTION

The present invention relates to a hanger device for a car mat and, more particularly, to a hanger device providing an enhanced positioning effect for a car mat.

A car mat is mounted on top of a car carpet to prevent the car carpet from becoming dirty. Hooks are provided on the car carpet to avoid the accelerator from coming in contact with and getting stuck on the car mat, with the hooks engaged with rigid fasteners in through-holes formed in the car mat to avoid displacement of the car mat.

FIG. 10 shows a car mat 1' hung on a conventional hanger device 3'. The car mat 1' is made of a soft material and includes through-holes 11'. The size of the through-holes 11' can be varied in response to differing hooks of different carpets for various cars. Lugs 12' are provided on a top side of the car mat 1' and are releasably engaged with the hanged device 3'. A fixing device 2' is mounted in each through-hole 11' and includes upper and lower fixing members 21' and 22' mounted to upper and lower faces of the car mat 1'. Each of the upper and lower fixing members 21' and 22' has a shape corresponding to the through-hole 11' and has a central through-hole 211', 221'. The upper and lower fixing members 21' and 22' are respectively mounted to the upper and lower faces of the car mat 1'. The central through-holes 211' and 221' are adapted to engaged with hooks on a car carpet. The hanger device 3' is made of a rigid material and includes a bottom side having a coupling portion 31' engaged with the lugs 12' of the car mat 1'. A hook 32' is formed on a top side of the hanger device 3' for hanging purposes. Thus, by using the hanger device 3', the car mat 1' can be hung in a market for display purposes. A user can clip the lugs 12' and mount the car mat 1' on a car carpet.

However, the position of the through-holes 11' of the car mat 1' must match the position of the hooks that may vary from car to car. Namely, the car mat 1' is only suitable to cars of a specific type. Mass production of the car mats 1' is limited, and the manufacturing costs of the car mats 1' are increased.

BRIEF SUMMARY OF THE INVENTION

An objective of the present invention is to provide a hanger device providing an enhanced positioning effect for a car mat.

A hanger device according to the present invention is made of a rigid plastic material. A car mat is adapted to be coupled to the hanger device. The hanger device includes a hooked portion and a plate formed below the hooked portion. The plate includes a coupling portion and a plurality of annular portions. The car mat is adapted to couple with the coupling portion. At least one fixing device is integrally formed on at least one of the plurality of annular portions. The at least one fixing device includes a through-hole. The at least one fixing device is separable from the at least one of the plurality of annular portions. The at least one fixing device is adapted to be mounted to the car mat.

Preferably, a cutter is integrally formed on one of the plurality of annular portions.

Preferably, each of the plurality of annular portions is hollow. A plurality of first ribs is integrally formed between the cutter and the one of the plurality of annular portions. A plurality of second ribs is formed between each of the at least one fixing device and one of the remaining annular portions. First openings are defined between the cutter and an inner periphery of the one of the plurality of annular portions.

Second openings are defined between each of the at least one fixing device and an inner periphery of one of the remaining annular portions.

Preferably, the cutter includes an annular metal blade and an operative button integrally formed with the annular metal blade. The annular metal blade includes a through-hole in an upper end thereof. An outer periphery of the operative button is integrally connected by the first ribs to the one of the plurality of annular portions. The annular metal blade includes an edge located below the operative button. The operative button is made of the rigid plastic material that is filled in and engaged in the through-hole of the annular metal blade.

Preferably, a protective cover is mounted on the annular metal blade.

Preferably, the at least one fixing device includes an upper fixing member and a lower fixing member. The upper fixing member includes a central through-hole and an outer periphery surrounding the central through-hole. An annular upper flange is formed on an upper end of the outer periphery of the upper fixing member. The annular upper flange is integrally formed with one of the plurality of annular portions. The outer periphery of the upper fixing member includes an engagement groove. The lower fixing member includes a through-hole having a diameter larger than a diameter of the outer periphery of the upper fixing member. The through-hole of the lower fixing member includes an inner periphery on which an engagement member is formed. The engagement member of the lower fixing member is adapted to be engaged in the engagement groove of the upper fixing member. The lower fixing member further includes an outer periphery having a diameter corresponding to a diameter of the annular metal blade. An annular lower flange is formed on a lower end of the outer periphery of the lower fixing member. The annular lower flange is integrally formed with another of the plurality of annular portions.

In another example, each of the at least one fixing device and the cutter includes an interconnecting portion interconnected to an inner periphery of one of the plurality of annular portions, with the interconnecting portion having a thickness smaller than a thickness of the plate.

The present invention will become clearer in light of the following detailed description of illustrative embodiments of this invention described in connection with the drawings.

DETAILED DESCRIPTION OF THE INVENTION

Figure 1:
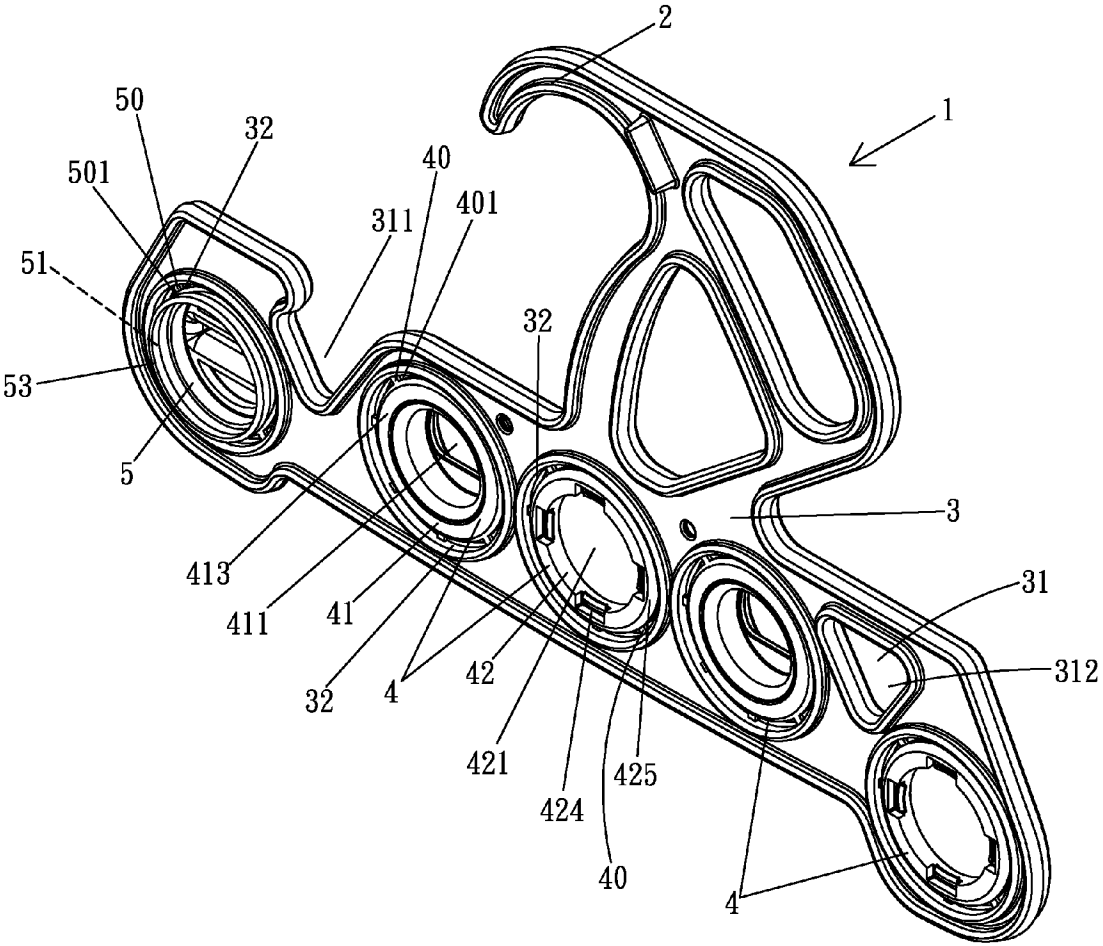
FIG. 1 shows a perspective view of a hanger device for a car mat according to the present invention.
Figure 2:
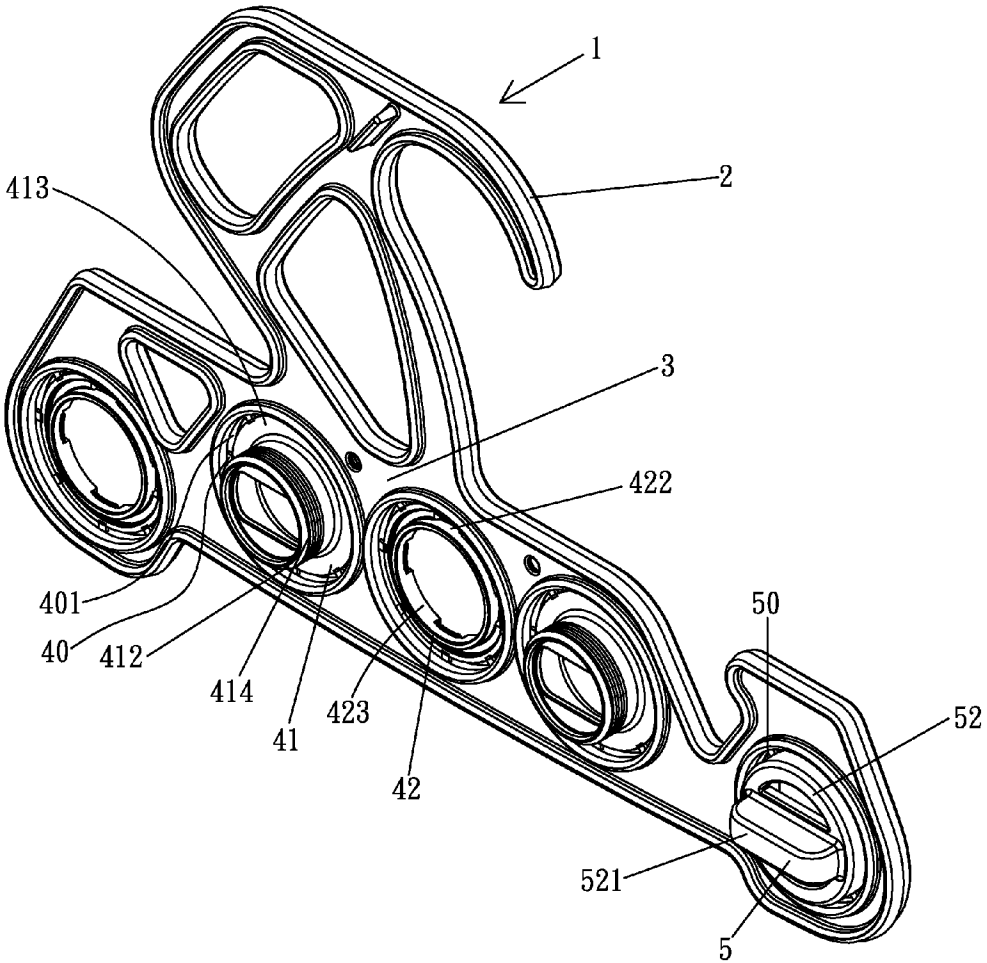
FIG. 2 shows another perspective view of the hanger device of FIG. 1.

With reference to FIGS. 1-6, a hanger device 1 according to the present invention is adapted to couple with a car mat 6 for display purposes. The hanger device 1 is made of a rigid plastic material and includes a hooked portion 2, a plate 3, two fixing devices 4, and a cutter 5. The hooked portion 2 allows the hanger device 1 to be hung on a hook or other object.

The plate 3 is formed below the hooked portion 1 and includes a coupling portion 31 having a recess 311 and a coupling hole 312 for coupling with the car mat 6. The plate 3 further includes five annular portions 32, with each annular portion 32 being hollow.

The fixing devices 4 are integrally formed on the annular portions 32, with a plurality of ribs 40 integrally formed between each fixing device 4 and one of the annular portions 32, with openings 401 defined between each fixing device 4 and an inner periphery of one of the annular portions 32. Each fixing device 4 includes an upper fixing member 41 and a lower fixing member 42. The upper fixing member 41 includes a central through-hole 411 and an outer periphery 412 surrounding the central through-hole 411. An annular upper flange 413 is formed on an upper end of the outer periphery 412 of the upper fixing member 41. The annular upper flange 413 is integrally formed with one of the annular portions 32 through the ribs 40. The outer periphery 412 of the upper fixing member 41 includes an engagement groove 414. The lower fixing member 42 includes a through-hole 421 having a diameter larger than a diameter of the outer periphery of 412 the upper fixing member 41. An engagement member 424 is formed on an inner periphery 423 of the lower fixing member 42. The engagement member 424 of the lower fixing member 42 is adapted to be engaged in the engagement groove 414 of the upper fixing member 41. An annular lower flange 425 is formed on a lower end of an outer periphery 422 of the lower fixing member 42. The annular lower flange 425 is integrally formed with another of the annular portions 32 through the ribs 40.

The cutter 5 is integrally formed on one of the annular portions 32 by ribs 50 integrally formed between an outer periphery of the cutter 5 and the annular portion 32, with openings 501 defined between the cutter 5 and an inner periphery of the annular portion 32. Specifically, the cutter 5 includes an annular metal blade 51, an operative button 52 integrally formed with the annular metal blade 51, and a protective cover 53 mounted on the annular metal blade 51. A diameter of the annular metal blade 51 corresponds to a diameter of the through-hole 421 of the lower fixing member 42. The annular metal blade 51 includes a through-hole 511 in an upper end thereof. An outer periphery of the operative button 52 is integrally connected by the ribs 50 to the annular portion 32. An edge of the annular metal blade 51 is located below the operative button 52. The operative button 52 includes a handle 521 allowing easy manual operation by a user. In formation of the hanger device 1, the annular metal blade 51 is mounted in placed in a mold, and the rigid plastic material is poured into the mold to fill and engage with the through-hole 511 of the blade 51, achieving integral formation. Note that the hooked portion 2, the plate 3, the fixing devices 4, and the cutter 5 are simultaneously formed. The protective cover 53 can be made independently and then mounted on the annular metal blade 51 for safety considerations.

Figure 3:
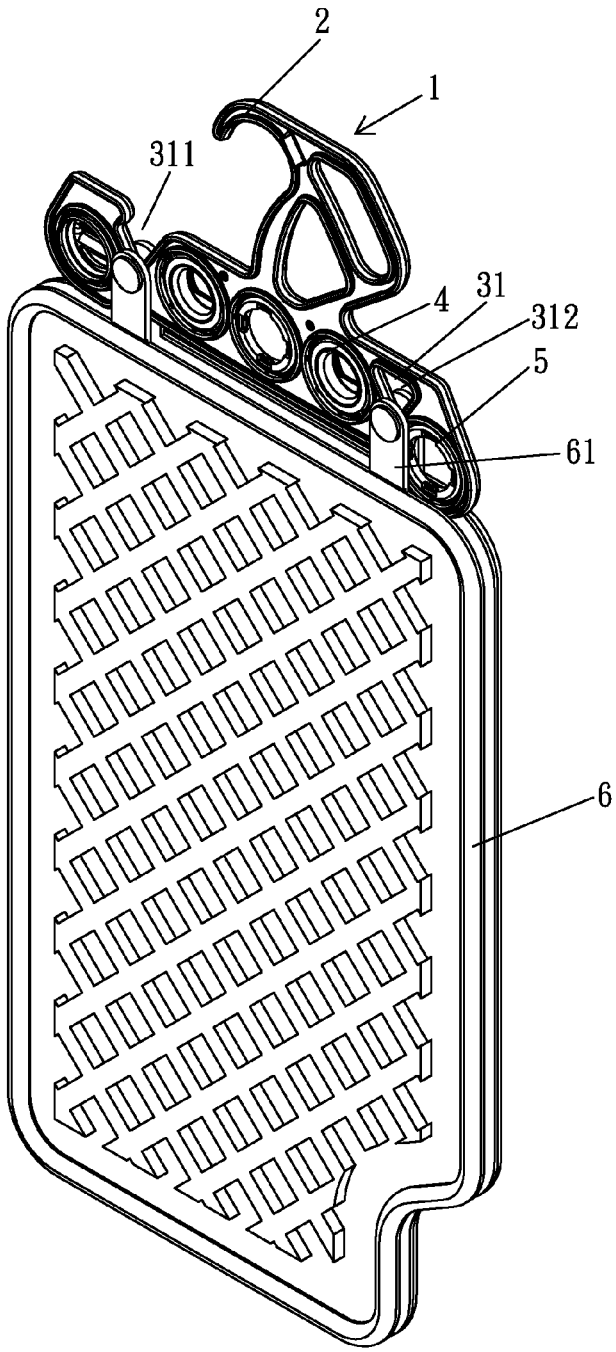
FIG. 3 shows a perspective view of the hanger device of FIG. 1 and a car mat hung on the hanger device.

With reference to FIG. 3, for display purposes, the recess 311 and the coupling hole 312 of the coupling portion 31 of the plate 3 of the hanger device 1 is coupled with two lugs 61 of the car mat 6. Thus, the car mat 6 can be hung in a market for display purposes by using the hooked portion 2 of the hanger device 1. The car mat 6 does not have to include through-holes.

Figure 4:
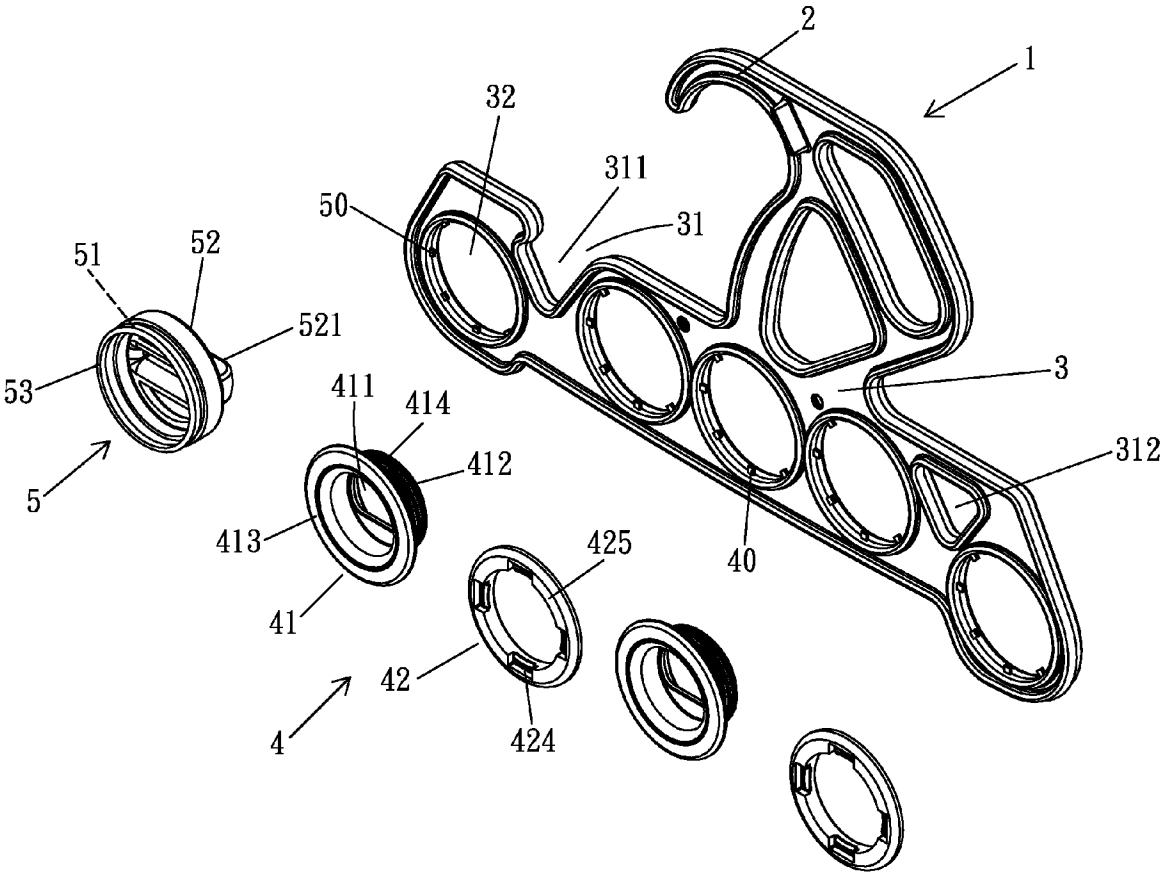
FIG. 4 shows an exploded, perspective view of the hanger device of FIG. 1.
Figure 5:
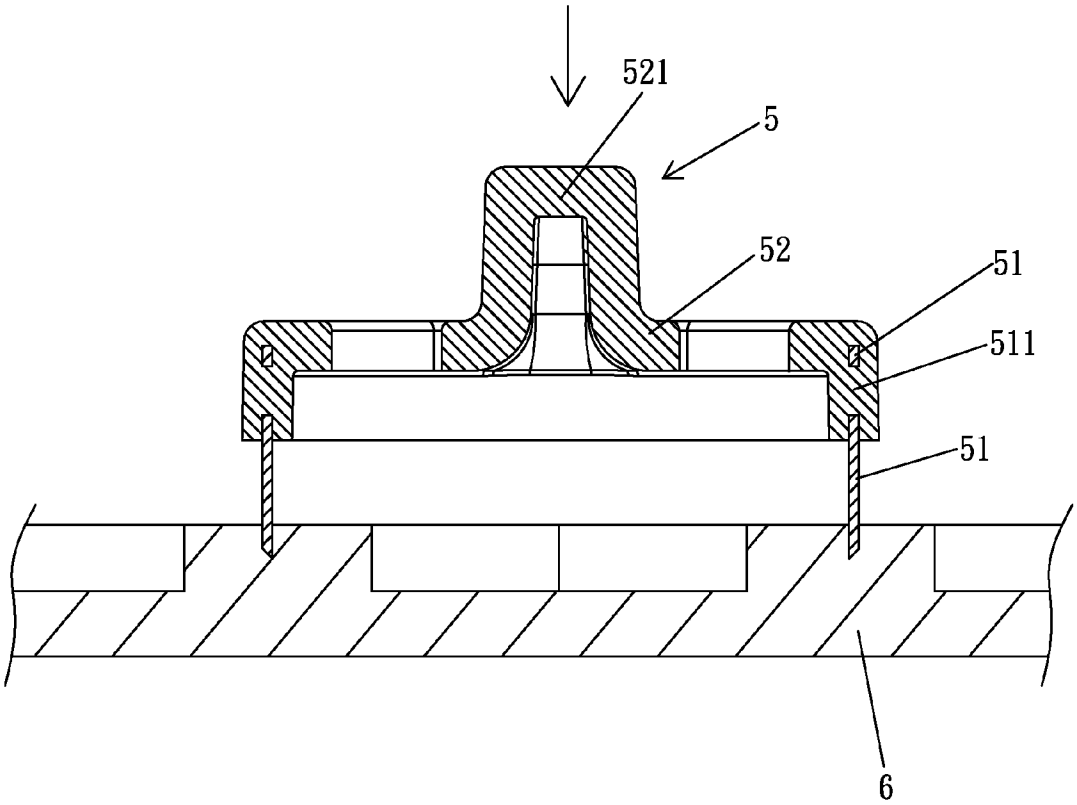
FIG. 5 shows schematic cross sectional view illustrating cutting of the car mat by a cutter of the hanger device of FIG. 1.
Figure 6:
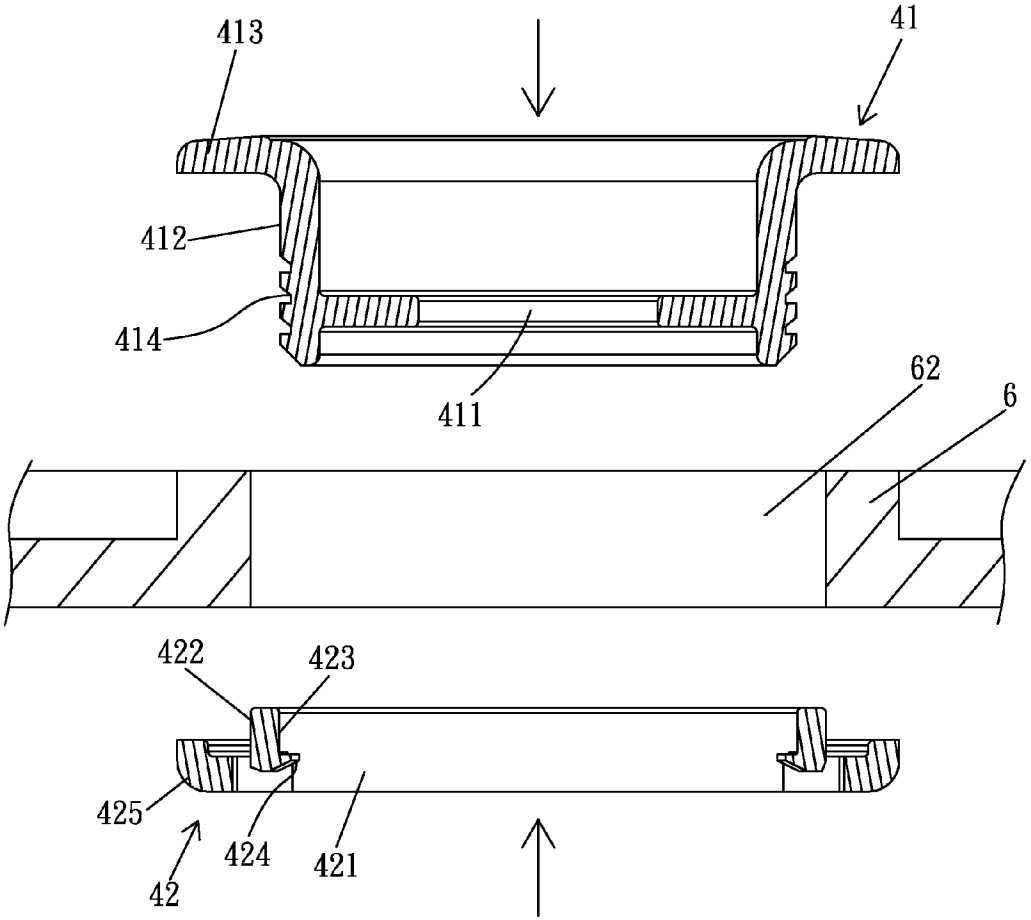
FIG. 6 shows an exploded, cross sectional view illustrating mounting of a fixing device of the hanger device of FIG. 1 to the car mat.

In use, the lugs 61 can be cut to separate the hanger device 1 from the car mat 6. With reference to FIG. 4, the user can break the ribs 40 and 50 by using a tool or by applying a force, separating the fixing devices 4 and the cutter 5 from the plate 3. With reference to FIGS. 1, 5, and 6, the protective cover 53 is removed, and the annular metal blade 51 is placed on the car mat 6 in a desired location. Then, the user applies a force on the cutter 5 to cut through the car mat 6, forming a through-hole 62 having a shape corresponding to the annular metal blade 51 for subsequent mounting of the fixing devices 4.

Figure 7:
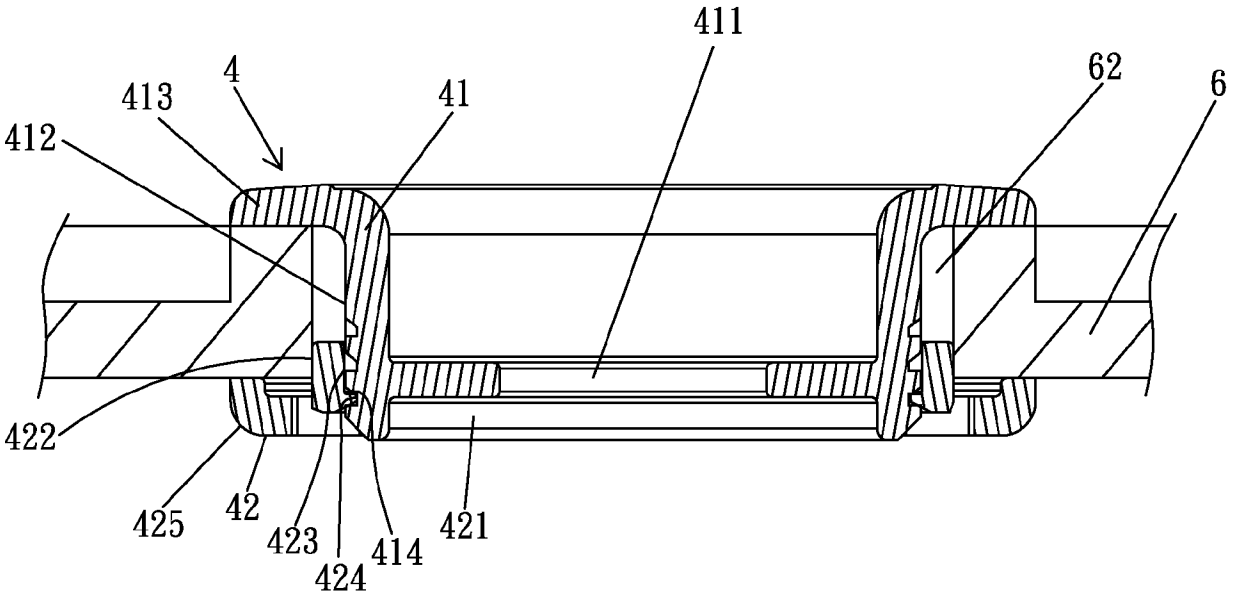
FIG. 7 shows a cross sectional view similar to FIG. 6, with the fixing device mounted to the car mat.
Figure 8:
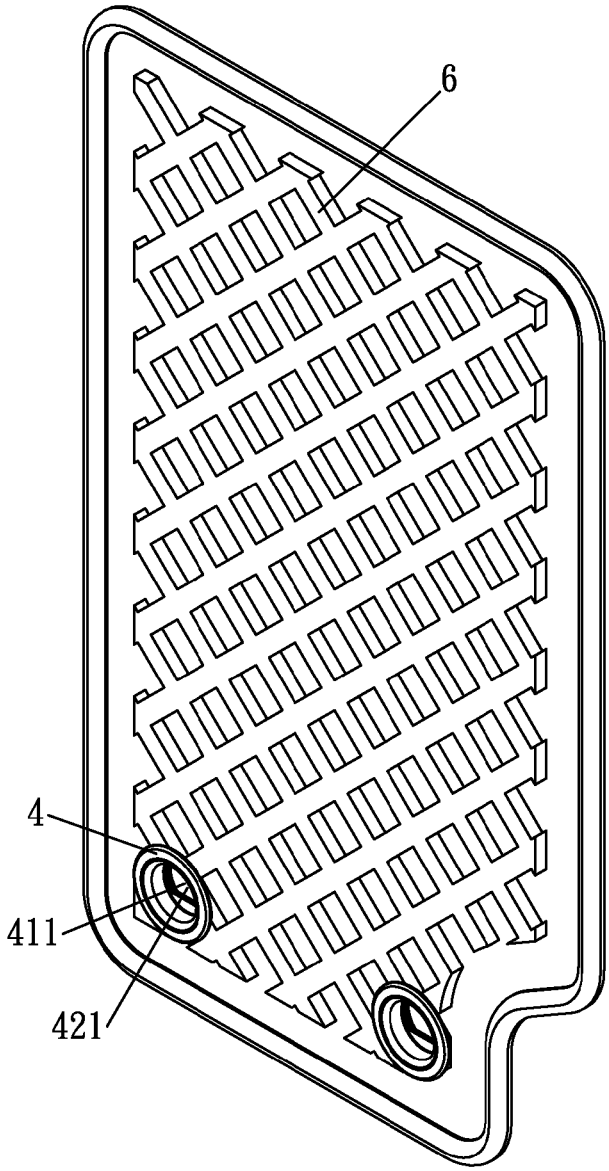
FIG. 8 shows a perspective view of the car mat and two fixing devices of FIG. 7.

With reference to FIGS. 6-8, one of the fixing devices 4 is mounted in the through-hole 62. Specifically, the upper and lower fixing members 41 and 42 are placed on upper and lower sides of the car mat 6 and then coupled with each other and engage in the through-hole 62 of the car mat 6, with the annular upper and lower flanges 413 and 425 respectively abutting the upper and lower sides of the car mat 6, with the engagement member 424 of the lower fixing member 42 engaged in the engagement groove 414 of the upper fixing member 41. The fixing device 4 can engage with a hook in a car to securely positioning the car mat 6 in the car.

Figure 9:
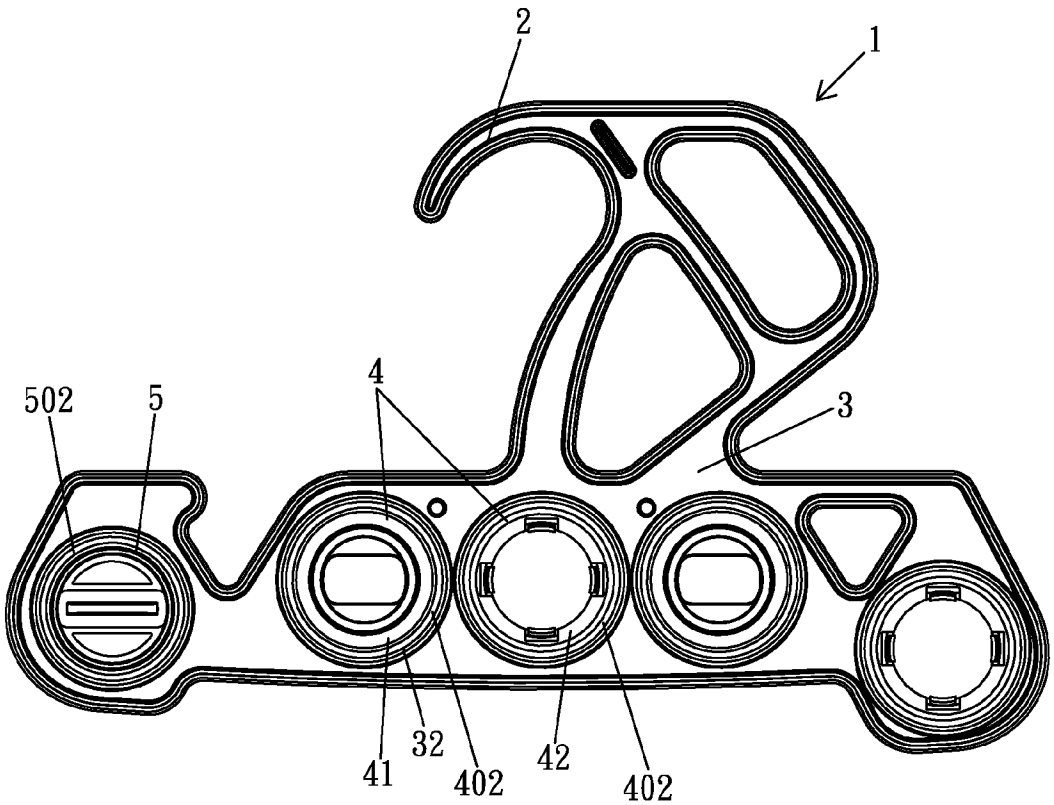
FIG. 9 shows a side view of a hanger device of another example according to the present invention.
Figure 10:
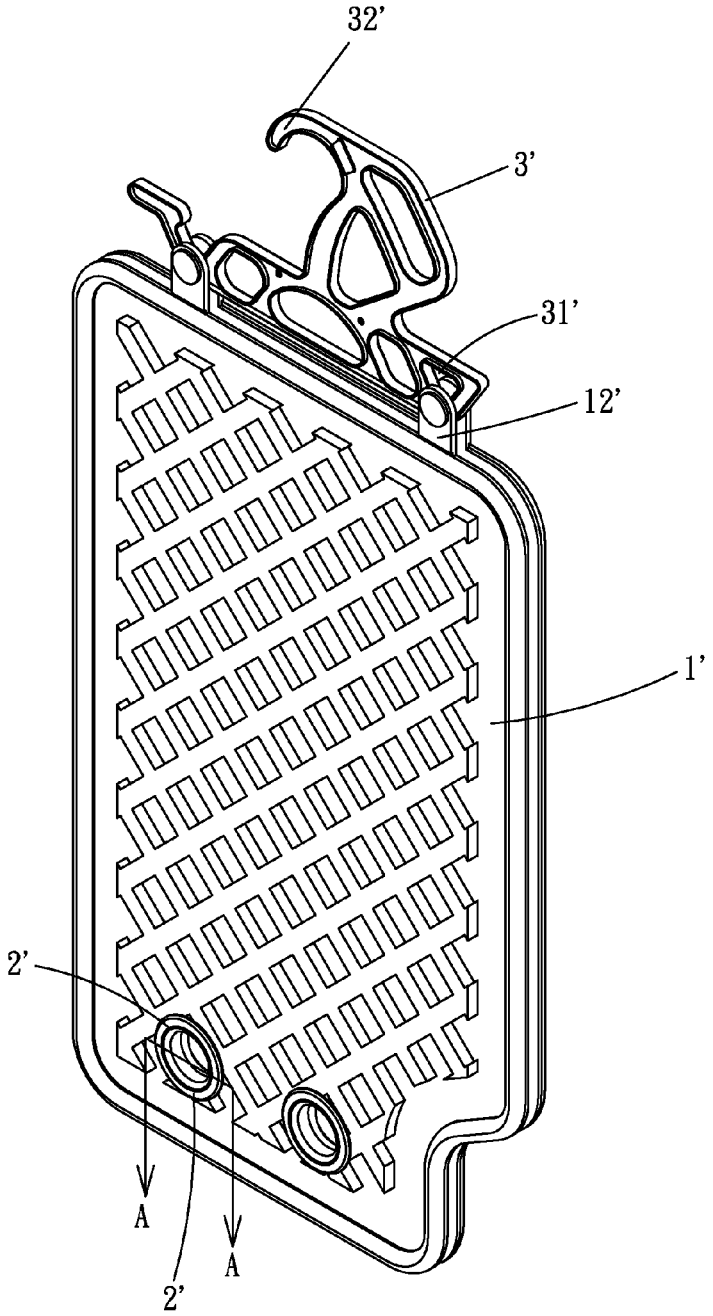
F I G . 10 PRIOR ART
FIG. 10 shows a perspective view of a conventional hanger device and a car mat.
Figure 11:
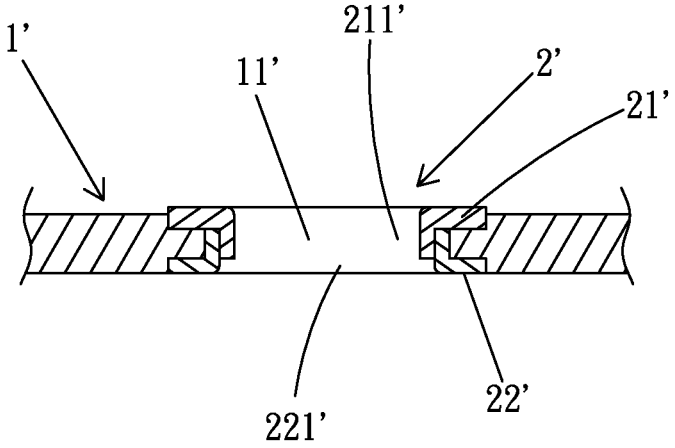
F I G .11 PRIOR ART
FIG. 11 shows a partial, cross sectional view taken along section line A-A of FIG. 10.

FIG. 9 shows another example of the present invention, wherein each fixing device 4 and the cutter 5 includes an interconnecting portion 402, 502 interconnected to one of the annular portions 32, with the interconnecting portion 402, 502 having a thickness smaller than a thickness of the plate 3. Thus, the user can simply apply a force to break the interconnecting portions 402 and 502 to separate the fixing device 4 and the cutter 5 from the plate 3 without using tools.

The hanger device 1 can be used with differing car mats 6 for cars of various types, significantly increasing the utility of the car mats 6 while allowing mass production of the car mats 6 and reducing the manufacturing costs of the car mats 6. The hanger device 1 does not have to include the cutter 5. An external cutting tool can be used to cut the car mat 6 to form the through-hole 62 for mounting the fixing devices 4.

Although specific embodiments have been illustrated and described, numerous modifications and variations are still possible without departing from the essence of the invention. The scope of the invention is limited by the accompanying claims.

The invention claimed is:

1. A hanger device made of a rigid plastic material, with a car mat adapted to be coupled to the hanger device, with the hanger device comprising:

a hooked portion;

a plate formed below the hooked portion, with the plate including a coupling portion and a plurality of annular portions, with the car mat adapted to couple with the coupling portion;

at least one fixing device integrally formed on at least one of the plurality of annular portions, with the at least one fixing device including a through-hole, with the at least one fixing device adapted to be mounted to the car mat; and a cutter integrally formed on one of the plurality of annular portions;

with each of the plurality of annular portions being hollow, with a plurality of first ribs integrally formed between the cutter and said one of the plurality of annular portions, with a plurality of second ribs formed between each of the at least one fixing device and one of remaining annular portions, with first openings defined between the cutter and an inner periphery of said one of the plurality of annular portions, with second openings defined between each of the at least one fixing device and an inner periphery of one of the remaining annular portions;

with the cutter including an annular metal blade and an operative button integrally formed with the annular metal blade, with the annular metal blade including a through-hole in an upper end thereof, with an outer periphery of the operative button integrally connected by the plurality of first ribs to said one of the plurality of annular portions, with the annular metal blade including an edge located below the operative button, with the operative button being made of the rigid plastic material, with the rigid plastic material filled in and engaged in the through-hole of the annular metal blade.

2. The hanger device as claimed in claim 1, further comprising: a protective cover mounted on the annular metal blade.

3. A hanger device made of a rigid plastic material, with a car mat adapted to be coupled to the hanger device, with the hanger device comprising:

a hooked portion;

a plate formed below the hooked portion, with the plate including a coupling portion and a plurality of annular portions, with the car mat adapted to couple with the coupling portion;

at least one fixing device integrally formed on at least one of the plurality of annular portions, with the at least one fixing device including a through-hole, with the at least one fixing device adapted to be mounted to the car mat, with the at least one fixing device including an upper fixing member and a lower fixing member, with the upper fixing member including a central through-hole and an outer periphery surrounding the central through-hole, with an annular upper flange formed on an upper end of the outer periphery of the upper fixing member, with the annular upper flange integrally formed with one of the plurality of annular portions, with the outer periphery of the upper fixing member including an engagement groove, with the lower fixing member including a through-hole having a diameter larger than a diameter of the outer periphery of the upper fixing member, with the through-hole of the lower fixing member including an inner periphery, with an engagement member formed on the inner periphery of the lower fixing member, with the engagement member of the lower fixing member adapted to be engaged in the engagement groove of the upper fixing member, with the lower fixing member further including an outer periphery having a diameter corresponding to a diameter of an annular blade, with an annular lower flange formed on a lower end of the outer periphery of the lower fixing member, with the annular lower flange integrally formed with another of the plurality of annular portions.

* * * * *